US011602197B2

(12) United States Patent
Mak et al.

(10) Patent No.: US 11,602,197 B2
(45) Date of Patent: Mar. 14, 2023

(54) QUICK STRING-TYING DEVICE AND METHOD

(71) Applicant: Yok Key Mak, Hong Kong (HK)

(72) Inventors: Yok Key Mak, Hong Kong (HK); Chi Yin Mak, Hong Kong (HK)

(73) Assignee: Yok Key Mak, Hong Kong (HK)

( * ) Notice: Subject to any disclaimer, the term of this patent is extended or adjusted under 35 U.S.C. 154(b) by 0 days.

(21) Appl. No.: 17/476,503

(22) Filed: Sep. 16, 2021

(65) Prior Publication Data

US 2022/0081249 A1 Mar. 17, 2022

Related U.S. Application Data

(60) Provisional application No. 63/078,919, filed on Sep. 16, 2020.

(51) Int. Cl.

| | |
|---|---|
| ***A43C 7/00*** | (2006.01) |
| ***D04G 5/00*** | (2006.01) |
| ***B65H 69/04*** | (2006.01) |

(52) U.S. Cl.

CPC ..... *A43C 7/005* (2013.01); *B65H 69/04* (2013.01); *D04G 5/00* (2013.01)

(58) Field of Classification Search

CPC ..... A43C 7/005; A43C 11/008; B65H 69/04; D04G 5/00

USPC ..... 289/17

See application file for complete search history.

(56) References Cited

U.S. PATENT DOCUMENTS

| | | | | | |
|---|---|---|---|---|---|
| 1,318,604 | A * | 10/1919 | Schneider | D04B 39/00 | 66/4 |
| 3,169,787 | A * | 2/1965 | Zolezzi | A01K 91/04 | 289/17 |
| 4,961,741 | A * | 10/1990 | Hayhurst | A61B 17/0469 | 606/139 |
| 6,167,598 | B1 * | 1/2001 | Pransky | A43C 7/08 | 24/712.9 |
| 6,334,240 | B1 * | 1/2002 | Li | F16G 11/101 | 24/712.1 |
| 6,381,816 | B1 * | 5/2002 | Lai | A43C 7/00 | 24/712.9 |
| 6,453,524 | B1 * | 9/2002 | Liu | A43C 7/08 | 24/115 G |
| 8,056,265 | B2 * | 11/2011 | Pirkle | A43C 7/00 | 24/712.1 |
| 8,136,848 | B1 * | 3/2012 | Angele | G09B 19/0076 | 289/17 |
| 8,292,335 | B1 * | 10/2012 | Hemingway | A63H 27/10 | 289/17 |

(Continued)

*Primary Examiner* — Shaun R Hurley

(57) ABSTRACT

The present application relates to a quick string-tying device including a first case body provided with a first bottom portion, a first open end, and a first sidewall extending and formed from the first bottom portion towards the first open end, the first bottom portion and the first sidewall forming a first accommodation space, the first bottom portion being provided with a first string-passing opening for two free ends of a string to pass therethrough, a slit formed on the first sidewall and extending from the first open end towards the first bottom portion, the slit being used to clamp the two free ends of the string which enter into the slit. The quick string-tying device is suitable for use on various items that require tying of a string, and can achieve quick tying and loosening of a string. A method for tying a string is also disclosed.

15 Claims, 18 Drawing Sheets

(56) References Cited

U.S. PATENT DOCUMENTS

| | | | | |
|---|---|---|---|---|
| 8,677,578 | B2 * | 3/2014 | Singh | A43C 7/005 24/712.2 |
| D707,732 | S * | 6/2014 | Crorey | D15/66 |
| 8,931,811 | B1 * | 1/2015 | Ng | D04B 5/00 289/17 |
| D755,258 | S * | 5/2016 | Ng | D15/66 |
| D758,836 | S * | 6/2016 | Symons | D8/383 |
| 9,867,429 | B2 * | 1/2018 | Hastings | A43C 1/06 |
| 10,264,774 | B2 * | 4/2019 | Walters | A01K 91/04 |
| 10,556,721 | B2 * | 2/2020 | Nelson | F16G 11/046 |
| D952,322 | S * | 5/2022 | Chang | D2/978 |
| 2004/0172796 | A1 * | 9/2004 | King, Jr. | A43D 999/00 24/712.5 |
| 2006/0107494 | A1 * | 5/2006 | Liao | F16G 11/14 24/18 |
| 2014/0319835 | A1 * | 10/2014 | Ng | A44C 27/00 289/17 |
| 2015/0123400 | A1 * | 5/2015 | Park | A43C 7/04 289/17 |
| 2016/0029745 | A1 * | 2/2016 | Atherinos | F16B 2/22 24/712.1 |
| 2018/0092435 | A1 * | 4/2018 | Bujalla | A43C 7/00 |
| 2020/0008532 | A1 * | 1/2020 | Chamberlain | A43C 1/00 |

* cited by examiner

QUICK STRING-TYING DEVICE AND METHOD

CROSS-REFERENCE TO RELATED APPLICATIONS

This application claims the benefit of U.S. provisional patent application No. 63/078,919 filed on Sep. 16, 2020, the entire content of which is hereby incorporated by reference.

TECHNICAL FIELD

The present application relates to a quick string-tying device and a method for tying a string.

BACKGROUND TECHNOLOGY

In daily life and a few other occasions, it often involves tying of a string, such as the tying of a string on shoes or clothes (such as trousers, short, etc.), and tying of a string on bags and pouches, etc. In order to achieve quick tying of a string, a few quick string-tying devices have been developed, but these devices generally have a more complicated structure, and have more parts.

SUMMARY

An object of the present application is to provide a quick string-tying device, including a first case body, the first case body being provided with a first bottom portion, a first open end, and a first sidewall extending and formed from the first bottom portion towards the first open end, the first bottom portion and the first sidewall forming a first accommodation space, the first bottom portion being provided with a first string-passing opening for two free ends of a string to pass therethrough, a slit formed on the first sidewall and extending from the first open end towards the first bottom portion, the slit being used to clamp the two free ends of the string which enter into the slit.

According to an embodiment of the quick string-tying device of the present application, the slit gradually tapers along a direction from the first open end towards the first bottom portion.

According to an embodiment of the quick string-tying device of the present application, the first bottom portion is provided with two first string-passing openings for passing the two ends of the string therethrough respectively.

According to an embodiment of the quick string-tying device of the present application, the first sidewall is formed with two slits extending from the first open end towards the first bottom portion.

According to an embodiment of the quick string-tying device of the present application, the slit includes a V-shaped opening section and an upright section connected to the V-shaped opening section, and a width of a narrowest gap of the V-shaped opening section which is joined to the upright section is smaller than a width of the string.

According to an embodiment of the quick string-tying device of the present application, further including a second case body, the second case body comprising a second bottom portion, a second open end, and a second sidewall extending and formed from the second bottom portion towards the second open end, the second bottom portion and the second sidewall forming a second accommodation space, the second case body being provided with a second string-passing opening for the string to pass therethrough.

According to an embodiment of the quick string-tying device of the present application, the first case body and the second case body are connected by a connecting portion.

According to an embodiment of the quick string-tying device of the present application, the second string-passing opening is provided on the second bottom portion of the second case body.

According to an embodiment of the quick string-tying device of the present application, the second case body extends from an outer side of the first sidewall of the first case body in a direction away from the first sidewall, the second bottom portion being formed at the first sidewall.

According to an embodiment of the quick string-tying device of the present application, the second string-passing opening is provided on the second sidewall or the second bottom portion.

Another object of the present application is to provide a method for tying a string, including: providing a quick string-tying device, the quick string-tying device including a first case body, the first case body being provided with a first bottom portion, a first open end, and a first sidewall extending and formed from the first bottom portion towards the first open end, the first bottom portion and the first sidewall forming a first accommodation space, the first bottom portion being provided with a first string-passing opening, a slit formed on the first sidewall and extending from the first open end towards the first bottom portion; passing two free ends of a string through the first string-passing opening; tying a slipknot with the two free ends or twisting the two free ends against each other to form a twisted portion; and moving the first case body upwards, or pulling the slipknot or the twisted portion downwards and into the first accommodation space, so that the slipknot or the twisted portion is clamped by the first accommodation space.

According to an embodiment of the method for tying a string, the first bottom portion is provided with two first string-passing openings, and the passing step includes passing the two free ends of the string through the two first string-passing openings respectively.

According to an embodiment of the method for tying a string, the method further includes, after the slipknot or the twisted portion is clamped by the first accommodation space, forcing the two free ends of the string into the slit.

A further object of the present application is to provide a method for tying a string, including: providing a quick string-tying device, the quick string-tying device comprising a first case body, the first case body being provided with a first bottom portion, a first open end, and a first sidewall extending and formed from the first bottom portion towards the first open end, the first bottom portion and the first sidewall forming a first accommodation space, the first bottom portion being provided with a first string-passing opening, a slit formed on the first sidewall and extending from the first open end towards the first bottom portion, and a second case body, the second case body comprising a second bottom portion, a second open end, and a second sidewall extending and formed from the second bottom portion towards the second open end, the second bottom portion and the second sidewall forming a second accommodation space, the second case body being provided with a second string-passing opening; passing two free ends of a string through the first string-passing opening; tying a first slipknot with the two free ends or twisting the two free ends against each other to form a twisted portion; continuously passing the two free ends through the second string-passing opening; tying a second slipknot with the two free ends;

pulling the second slipknot into the second accommodation space so that the two free ends are secured in the second accommodation space; and adjusting a length of the two free ends between the first and second case bodies so that the first slipknot or the twisted portion is locked in the first accommodation space.

According to an embodiment of the method for tying a string, the first bottom portion is provided with two first string-passing openings, and the passing step includes passing the two free ends of the string through the two first string-passing openings respectively.

According to an embodiment of the method for tying a string, the method further includes pressing a portion of the two free ends between the first and second case bodies into the slit.

The quick string-tying device of the present application is suitable for various items that need tying of a string, and can achieve quick tying and loosening of the string.

BRIEF DESCRIPTION OF THE DRAWINGS

The present disclosure will be further explained in conjunction with the following embodiments and the accompanying drawings in which.

DETAILED DESCRIPTION OF EMBODIMENTS

Figure 1:
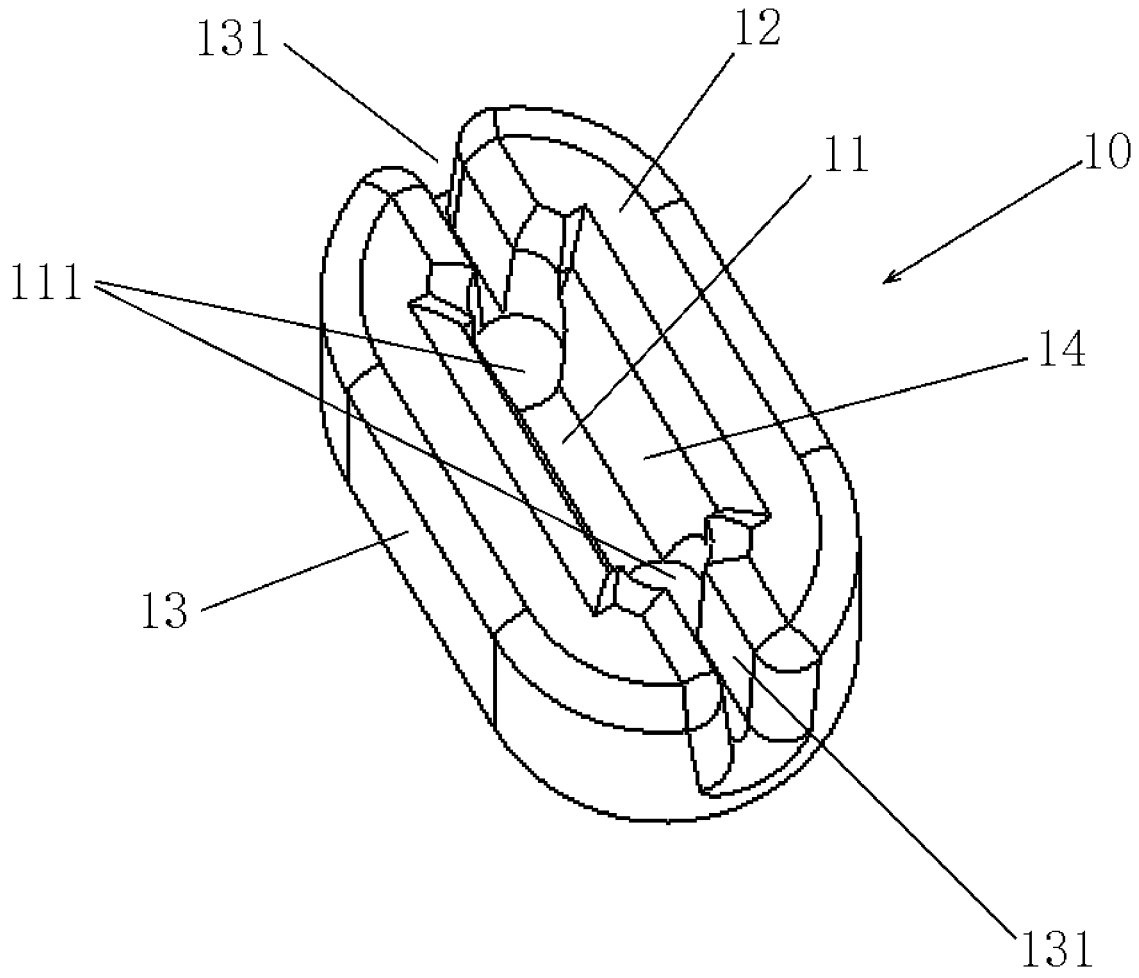
FIG. 1 is a perspective schematic view of a first embodiment of the quick string-tying device of the present application.

In order to have a clearer understanding of the technical features, purposes and effects of the present disclosure, specific embodiments of the present disclosure will now be described in detail with reference to the accompanying drawings.

The following describes in detail the embodiments of the quick string-tying device of the present application. Examples of these embodiments are shown in the drawings, wherein the same or similar reference numerals indicate the same or similar elements or elements with the same or similar functions.

In the description of the quick string-tying device of the present application, it should be understood that the terms "front", "rear", "upper", "lower", "upper end", "lower end", "upper portion", "lower portion", etc., are indications of orientation or positional relationship based on the orientation or positional relationship shown in the drawings. They are only used for the convenience of describing the present disclosure and simplifying the description, and do not indicate or imply that the device or element referred to must have a specific orientation, or a specific orientation with regard to its structure and operation. Therefore, it cannot be construed as a limitation of the present application. In addition, the terms "first", "second", etc. are only used for descriptive purposes, and cannot be understood as indicating or implying relative importance.

Figure 2:
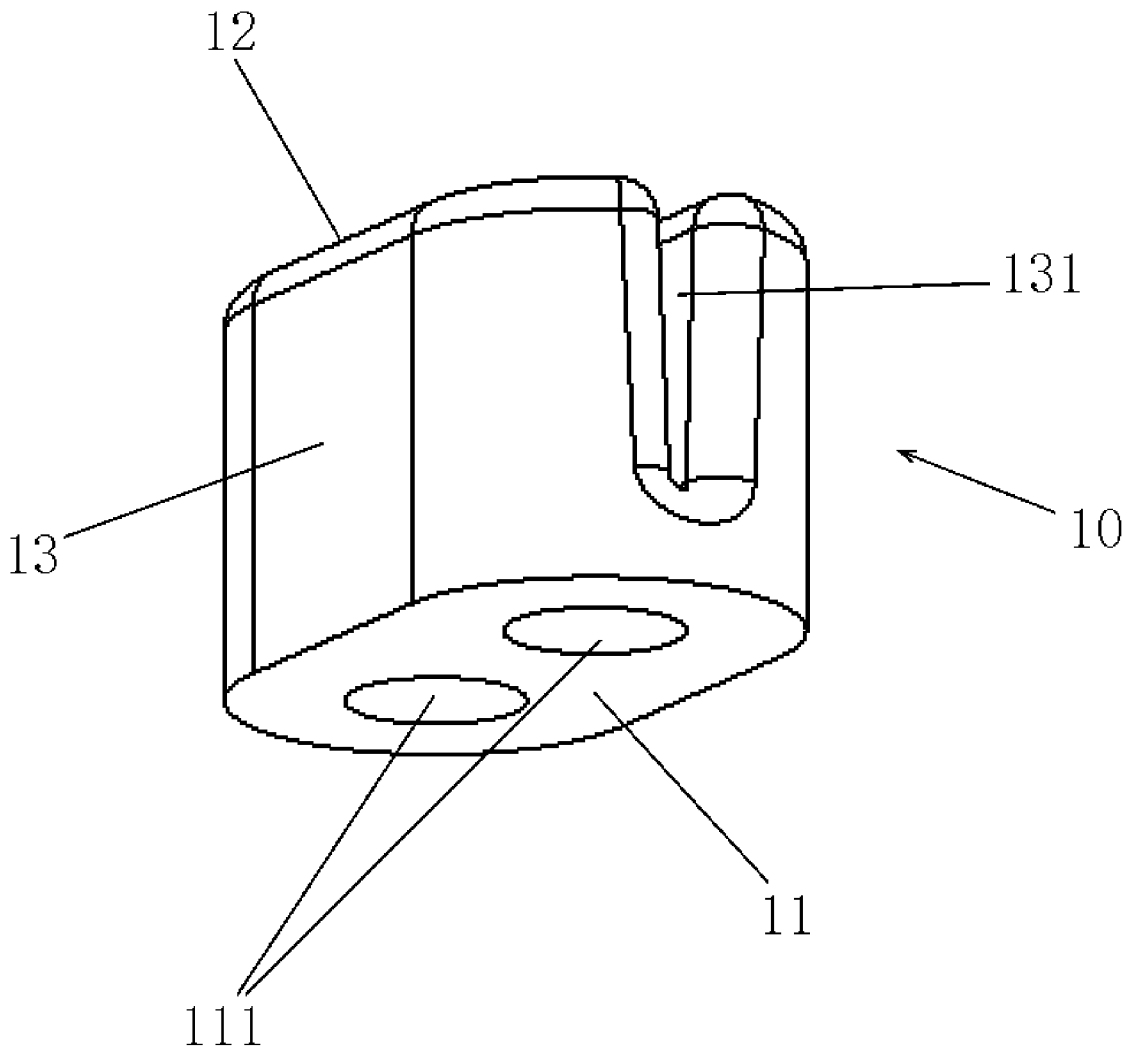
FIG. 2 is a perspective schematic view from another angle of the first embodiment of the quick string-tying device of the present application.

FIG. 1 and FIG. 2 are schematic views of a first embodiment of the quick string-tying device of the present application. The quick string-tying device of the present embodiment includes a first case body 10, the first case body 10 is provided with a first bottom portion 11, a first open end 12, and a first sidewall 13 that is extending and formed from the first bottom portion 11 towards the first open end 12, the first bottom portion 11 and the first sidewall 13 form a first accommodation space 14, the first bottom portion 11 is provided thereon with two first string-passing openings 111 for two free ends 21, 22 of a string to pass therethrough respectively, two slits 131 are formed on the first sidewall 13 and extend from the first open end 12 towards the first bottom portion 11, each slit 131 gradually tapers along a direction from the first open end 12 towards the first bottom portion 11, the two slits 131 respectively correspond to the two first string-passing openings 111, i.e., the lower end of each slit 131 is close to a corresponding first string-passing opening 111. The first string-passing openings 111 are appropriately sized so that the string or the two free ends 21, 22 of the string can pass, the first accommodation space 14 is sized so that the two free ends 21, 22 of the string can be clamped by the first accommodation space 14 after the two free ends 21, 22 of the string are passed through the first string-passing openings 111, tied into a slipknot, and pulled into the first accommodation space 14, if the string is easy to become loose, such as a fishing line, then one more knot may be tied. When the two free ends 21, 22 of the string are pulled into the first accommodation space 14 and are clamped by it, the first accommodation space 14 can prevent the two free ends 21, 22 of the string from becoming loose, and this has the effect of quick tying of the string. The slits 131 can clamp the strips that enter the slits 131, especially the portions of the slits 131 that are close to the bottom portion, since their widths are smaller, they can tightly clamp the two free ends 21, 22 of the string that are located here. The slits 131 can have a string-locking effect.

Figure 3:
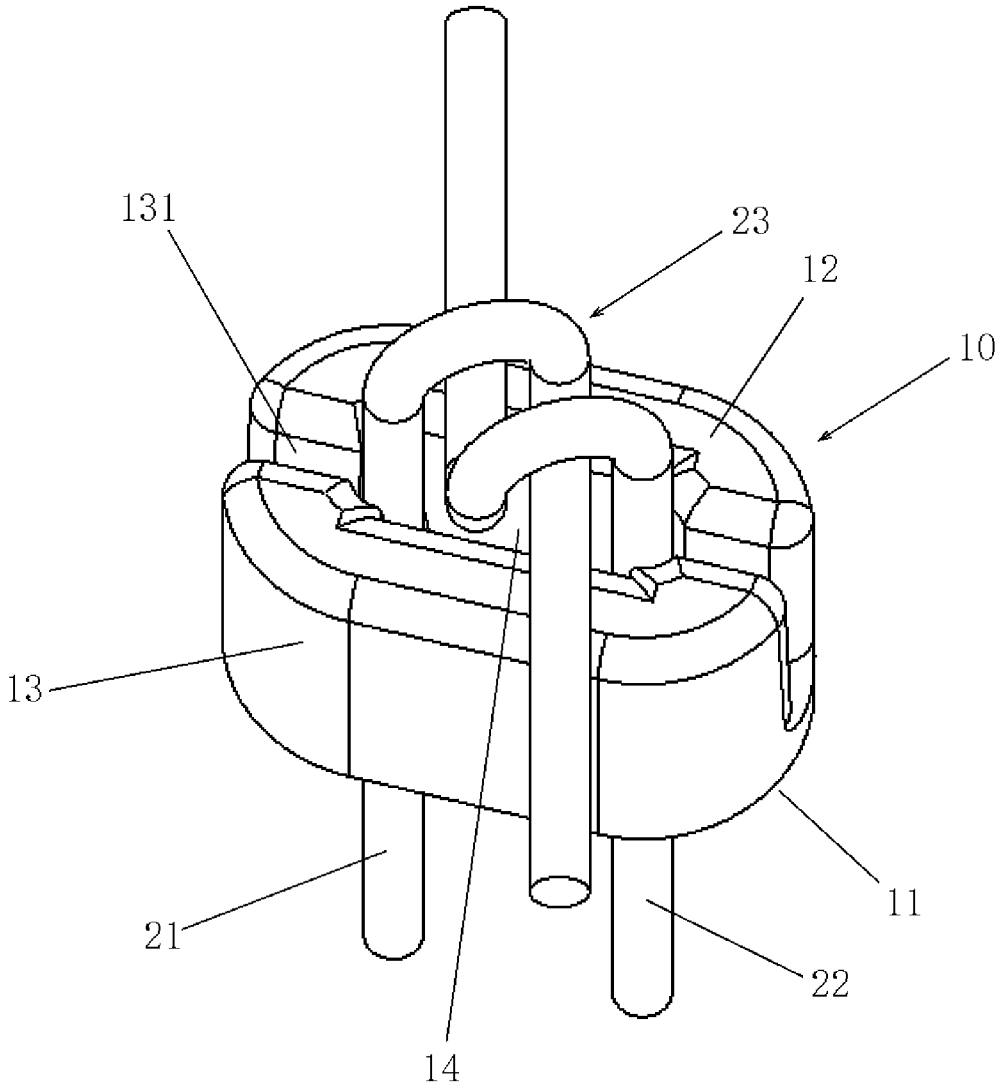
FIG. 3 is a schematic diagram of a string-tying method for the first embodiment of the quick string-tying device of the present application.

FIG. 3 shows a schematic diagram of a string-tying method for the first embodiment of the quick string-tying device of the present application, in this embodiment, two free ends 21, 22 of a string are passed through the first string-passing openings 111 of the first bottom portion 11 of the first case body 10 and are then tied into a slipknot 23, the first case body 10 is moved upwards, or the two free ends 21, 22 of the string are pulled downwards, the slipknot 23 will enter the first accommodation space 14 of the first case body 10 and will be clamped by the first accommodation space 14, since the slipknot 23 needs a certain space to become loose, especially in the case that the two free ends 21, 22 of the string have not been pulled straight, the slipknot 23 will be locked in the first accommodation space 14 and cannot be loosened, this achieves the object of quick tying of a string. When loosening is needed, the two free ends 21, 22 of the string can be pulled upwards, and when the slipknot 23 is pulled out from the first accommodation space 14, the two free ends 21, 22 of the string can be easily loosened, there may be only one first string-passing opening 111, which suitably can allow the slipknot 23 to pass through smoothly. When the quick string-tying device is provided with the slits 131, the two free ends 21, 22 of the string may be pulled outwards and forced into the slits 131, so that the slipknot 23 can be further clamped in the slits 131, when loosening is required, one only needs to pull the two free ends 21, 22 of the string out from the slits 131 towards the first open end 12 of the first case body 10.

Figure 4:
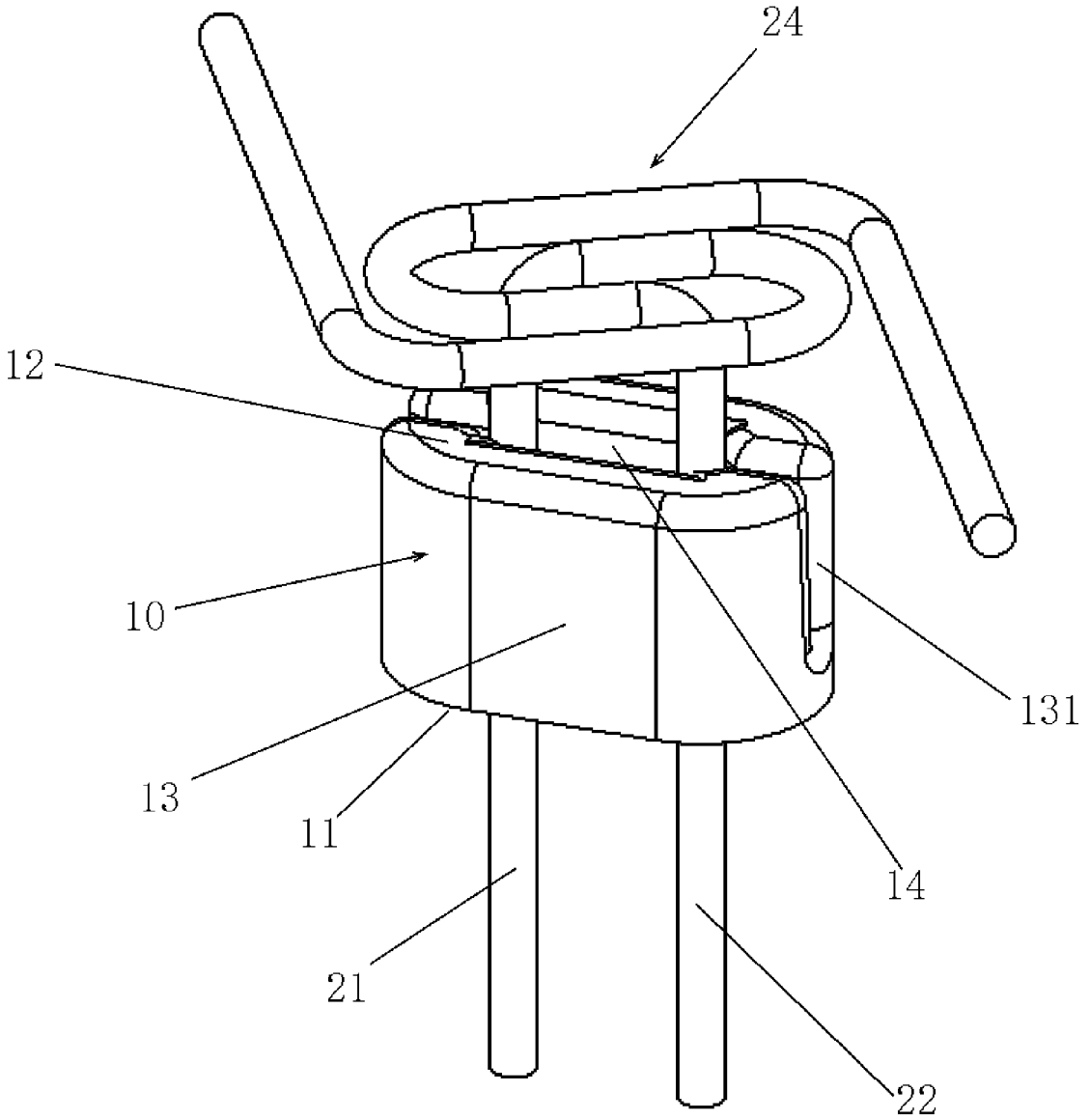
FIG. 4 is a schematic diagram of another string-tying method for the first embodiment of the quick string-tying device of the present application.

FIG. 4 shows a schematic diagram of another string-tying method for the first embodiment of the quick string-tying device of the present application, in this embodiment, the two free ends 21, 22 of the string are passed through the first string-passing openings 111 of the first bottom portion 11 of the first case body 10, and are then twisted against each other, and are not tied into a knot, the two free ends 21, 22 of the string form a twisted portion 24, the first case body 10 is moved upwards, or the two free ends 21, 22 of the string are pulled downwards, the twisted portion 24 will enter the first accommodation space 14 of the first case body 10 and will be clamped by the first accommodation space 14, since the twisted portion 24 needs a certain space to become loose, especially in the case that the two free ends 21, 22 of the string have not been pulled straight, the twisted portion 24 will be locked in the first accommodation space 14 and cannot be loosened, this achieves the object of quick tying of a string. When loosening is needed, the two free ends 21, 22 of the string can be pulled upwards, and when the twisted portion 24 is pulled out from the first accommodation space 14, the two free ends 21, 22 of the string can easily become loose. When the quick string-tying device is provided with slits 131, the two free ends 21, 22 of the string may be pulled outwards and forced into the slits 131, so that the twisted portion 24 can be further clamped in the slits 131, when loosening is needed, the two free ends 21, 22 of the string are pulled out from the slits 131 towards the first open end 12 of the first case body 10.

It should be understood that the quick string-tying device of the present application is not limited to the above structure, the number of the first string-passing opening 111 may be one or more, preferably two, the position of the first string-passing openings 111 is not limited to be on the first bottom portion 11, they may be formed on the first sidewall 13 of the first case body 10, the first string-passing openings 111 may be of various appropriate shapes, and may not be limited to circular, the first sidewall 13 of the first case body 10 may not be upright, the first sidewall 13 may not be perpendicular to the first bottom portion 11. When there is no partition between the two first string-passing openings 111, then the two first string-passing openings 111 are joined together as one, and become one opening, this can solve the demolding problem during injection molding. It should be understood that the slits 131 are not limited to the form of slits that gradually taper along a direction from the open end towards the bottom portion, the slits 131 may be parallel, or may be arc-shaped, the bottom of each slit 131 may be relatively wide, the slit relies on its upper, lower or slanted surfaces to clamp the string, and can be more effective in preventing the string from moving towards the open end.

Figure 5:
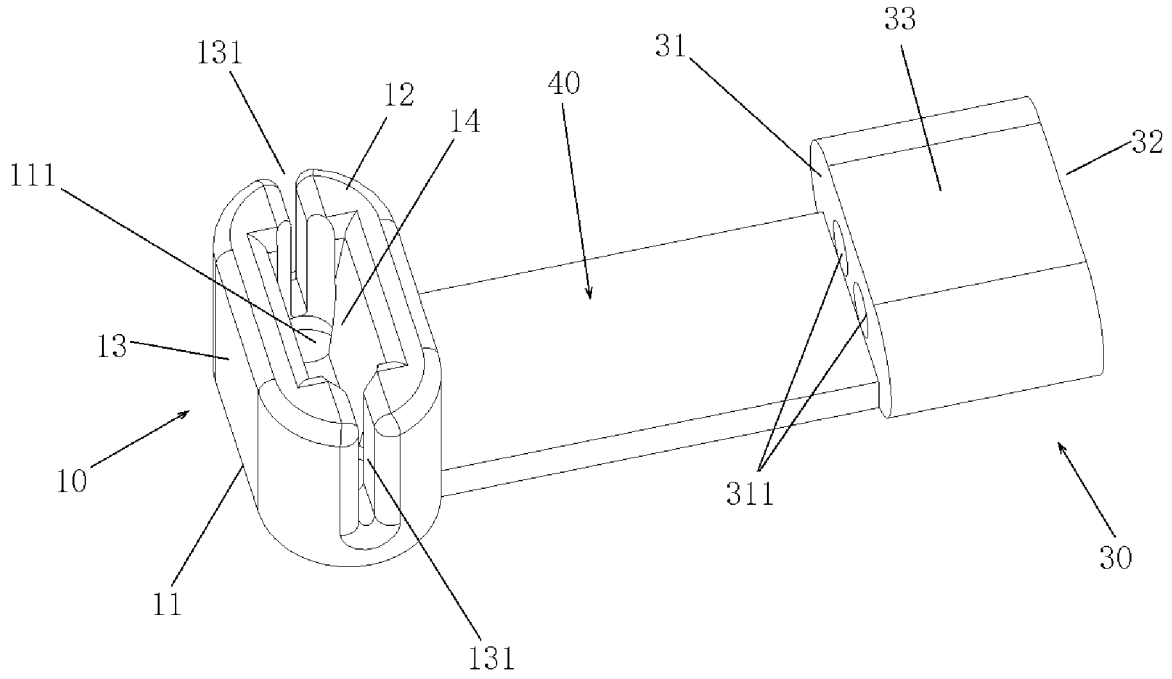
FIG. 5 is a perspective schematic view of another embodiment of the quick string-tying device of the present application.
Figure 6:
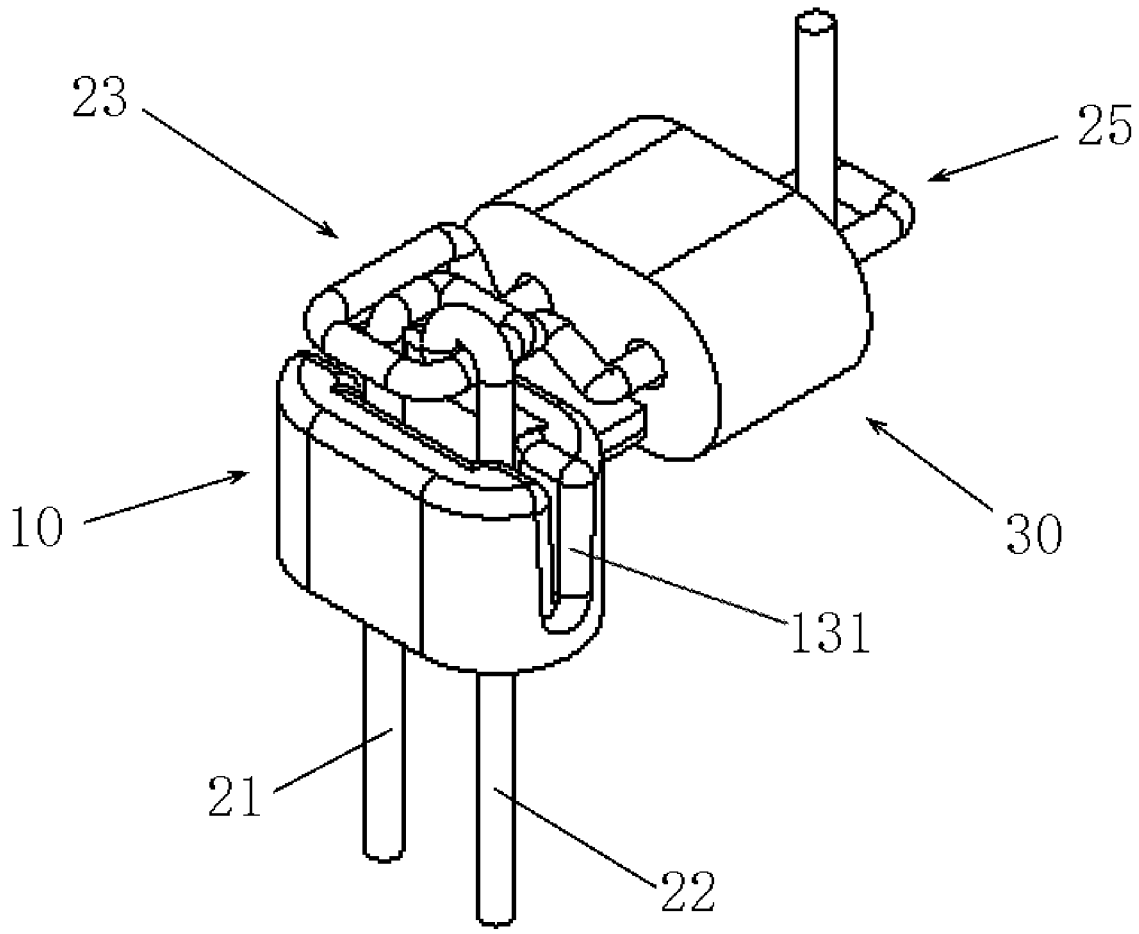
FIG. 6 is a schematic diagram of a string-tying method for another embodiment of the quick string-tying device of the present application.
Figure 7:
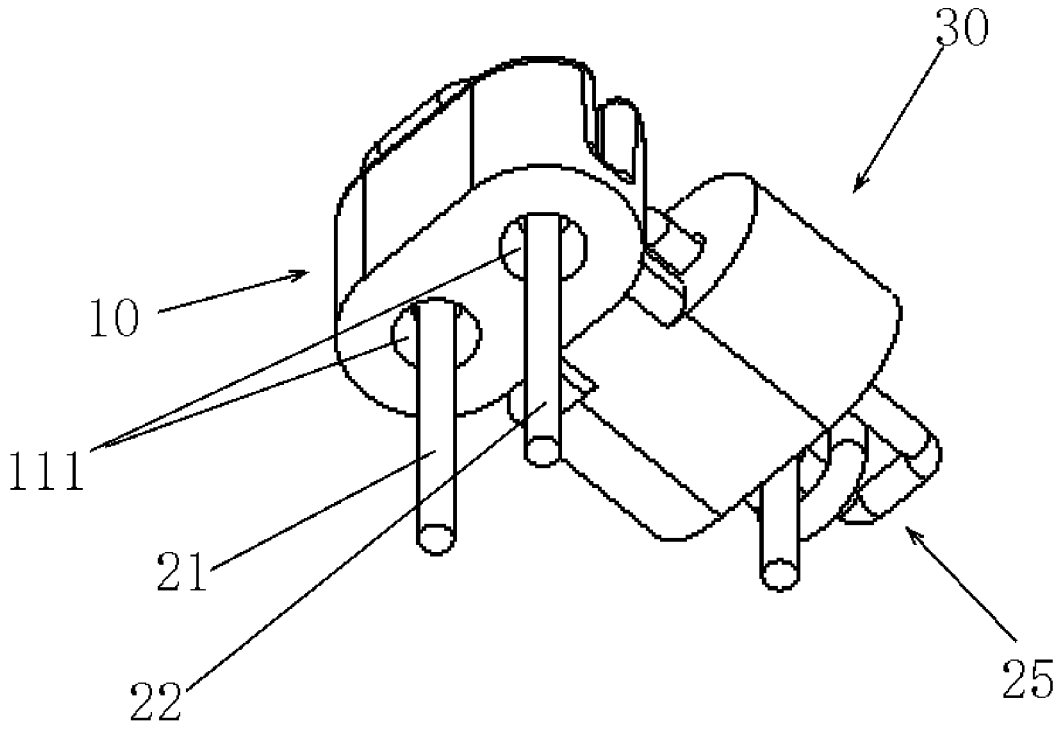
FIG. 7 is a perspective schematic view from another angle of the quick string-tying device of the present application shown in FIG. 6.
Figure 8:
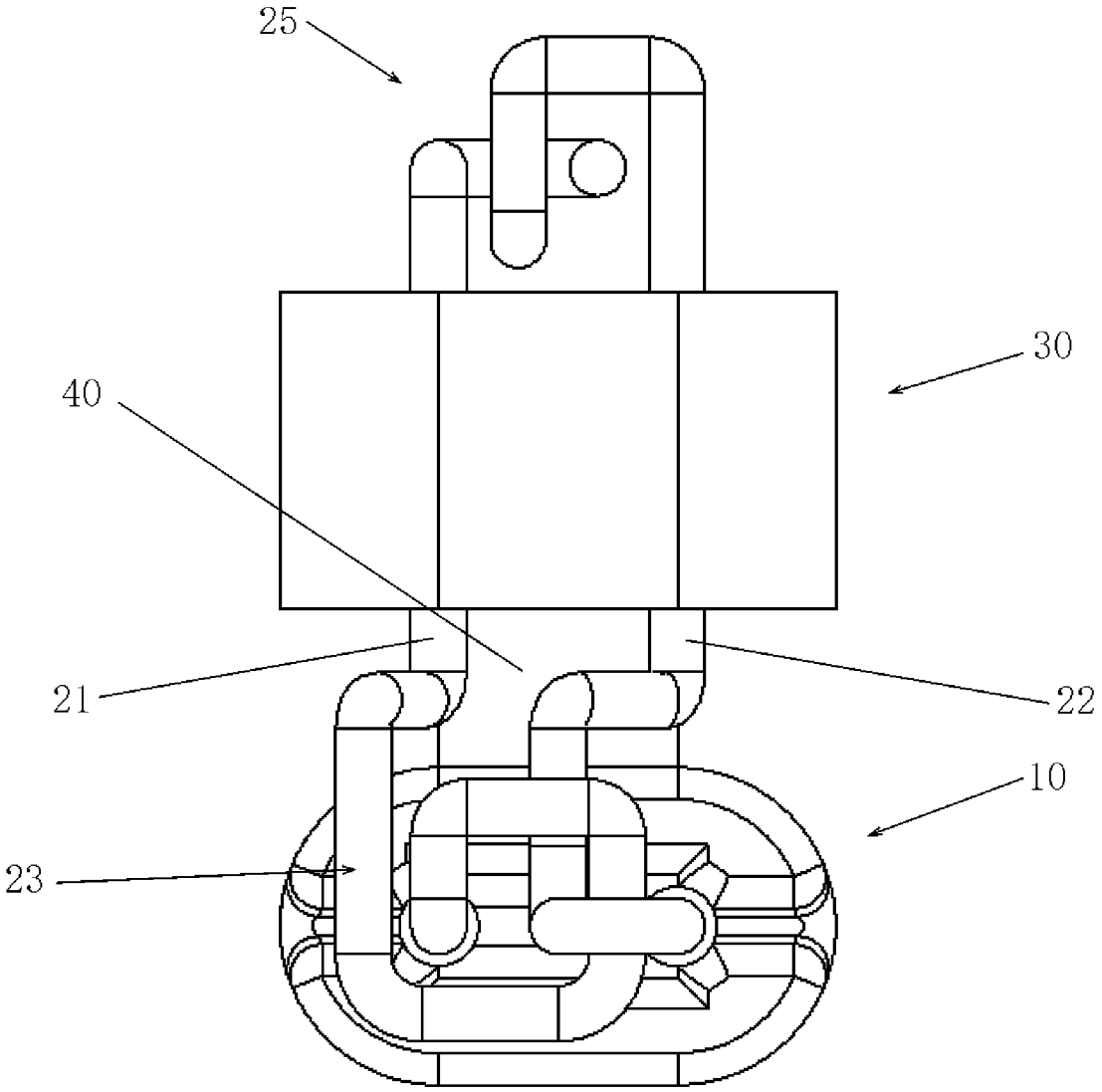
FIG. 8 is a schematic top view of the quick string-tying device of the present application shown in FIG. 6.
Figure 9:
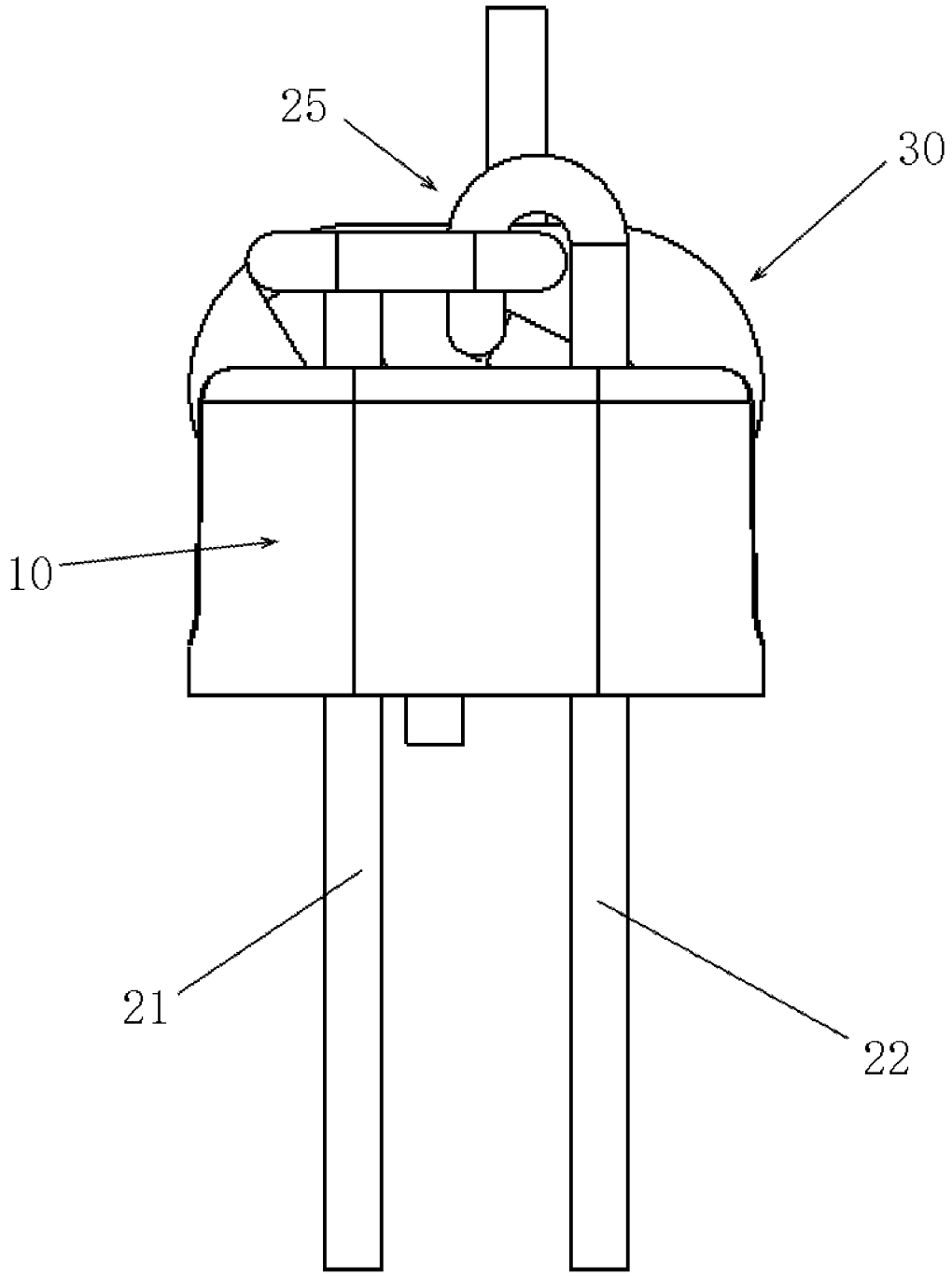
FIG. 9 is a schematic front view of the quick string-tying device of the present application shown in FIG. 6.
Figure 10:
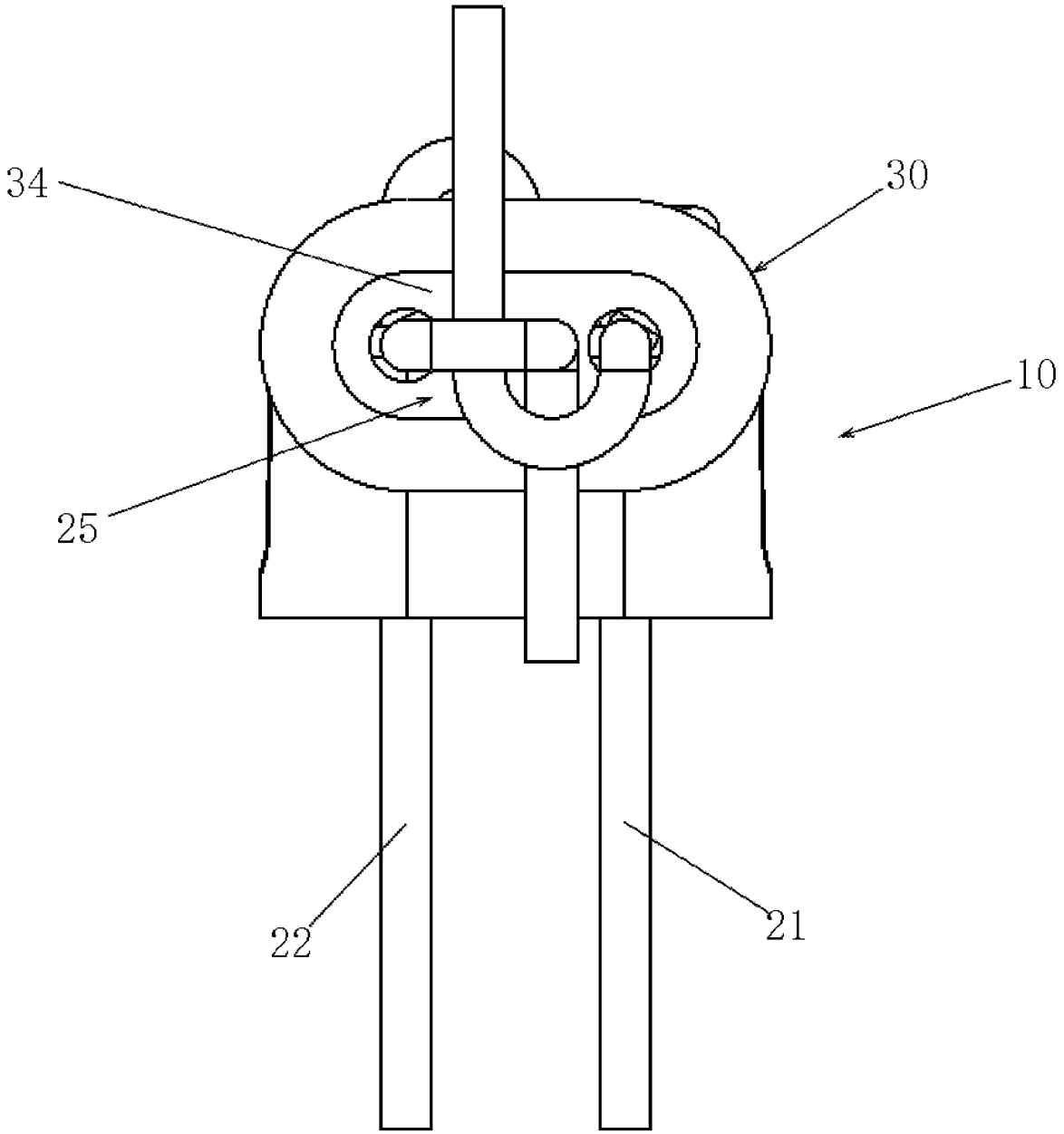
FIG. 10 is a schematic rear view of the quick string-tying device of the present application shown in FIG. 6.
Figure 11:
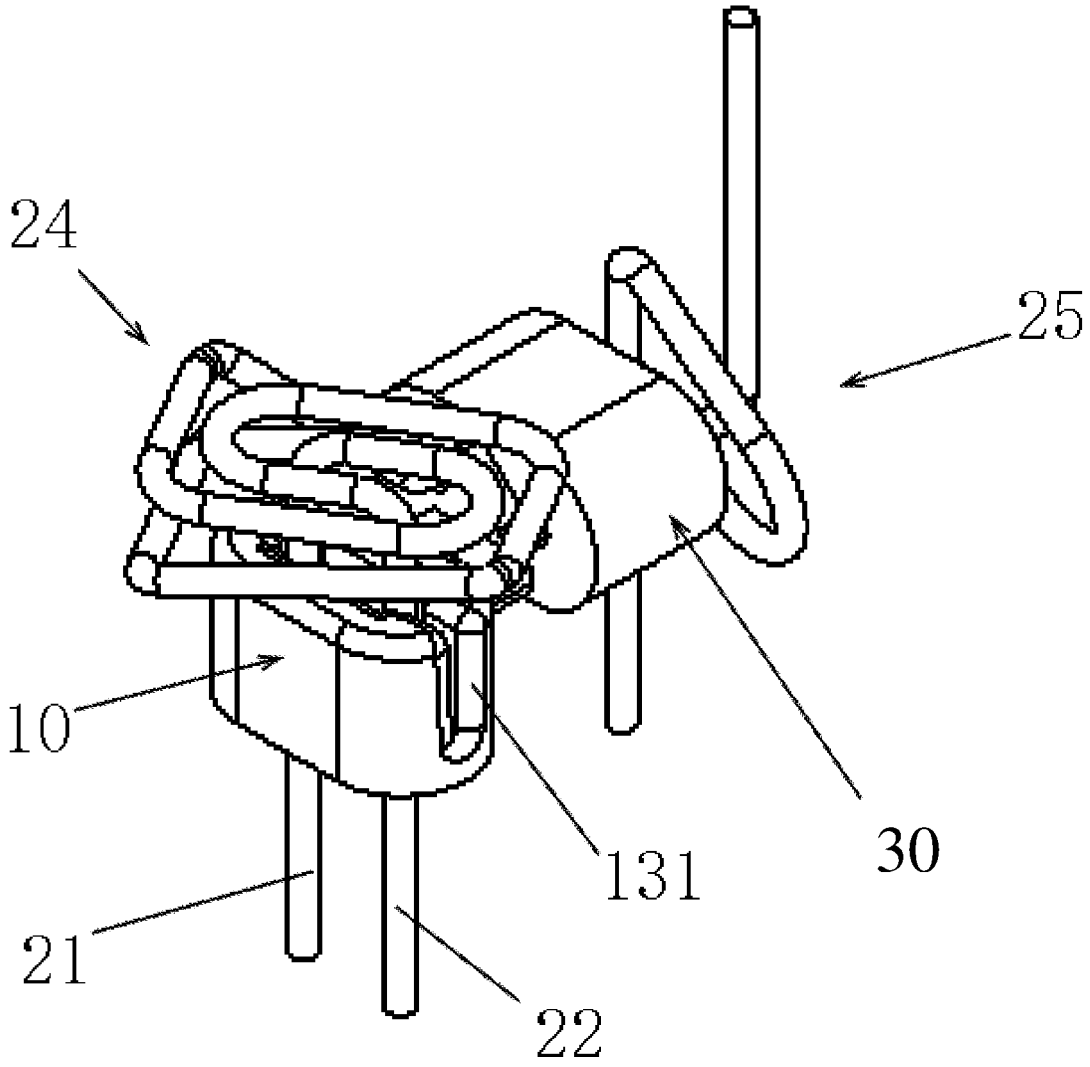
FIG. 11 is a schematic diagram of another string-tying method for another embodiment of the quick string-tying device of the present application.
Figure 12:
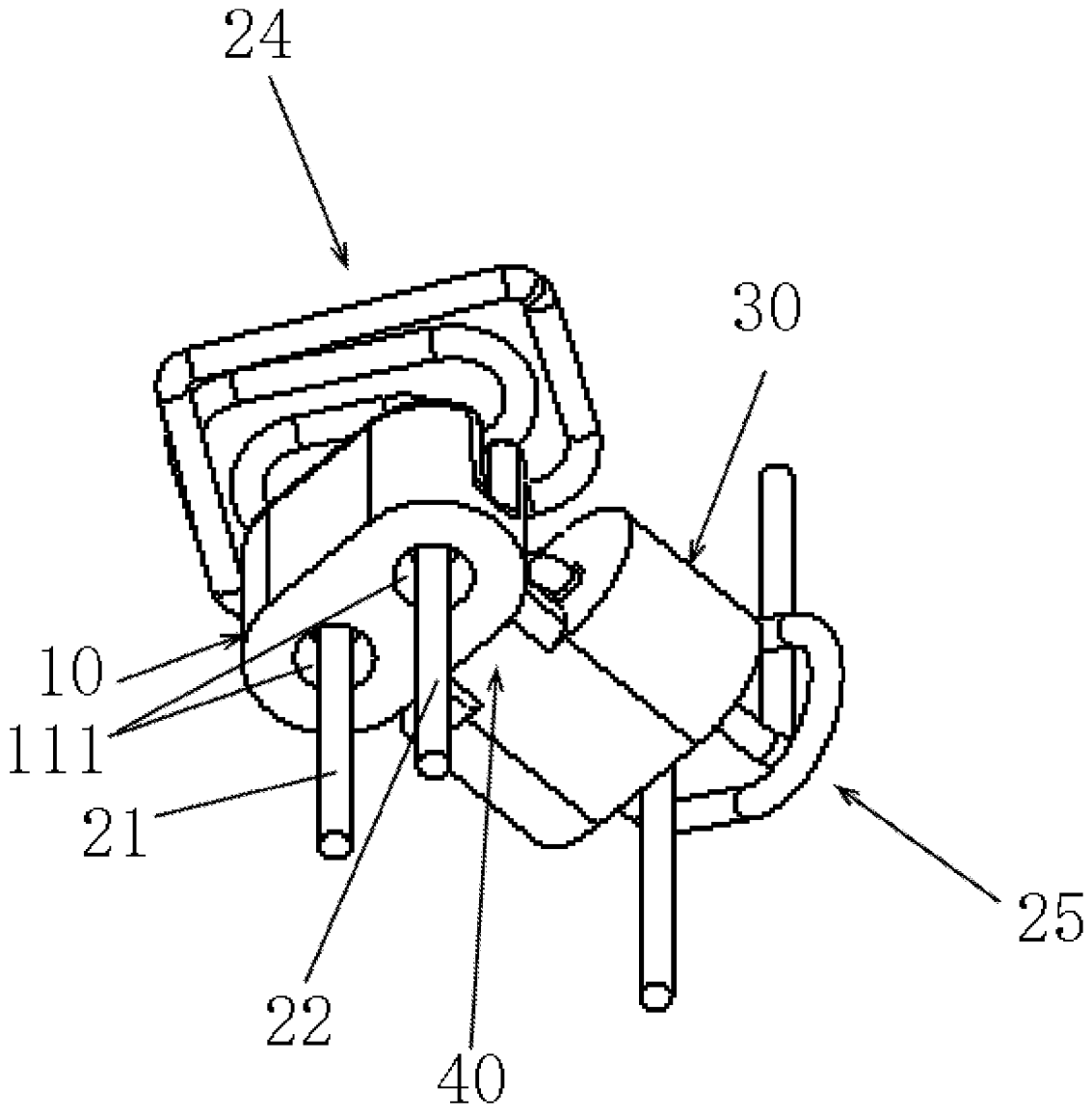
FIG. 12 is a perspective schematic view from another angle of the quick string-tying device of the present application shown in FIG. 11.
Figure 13:
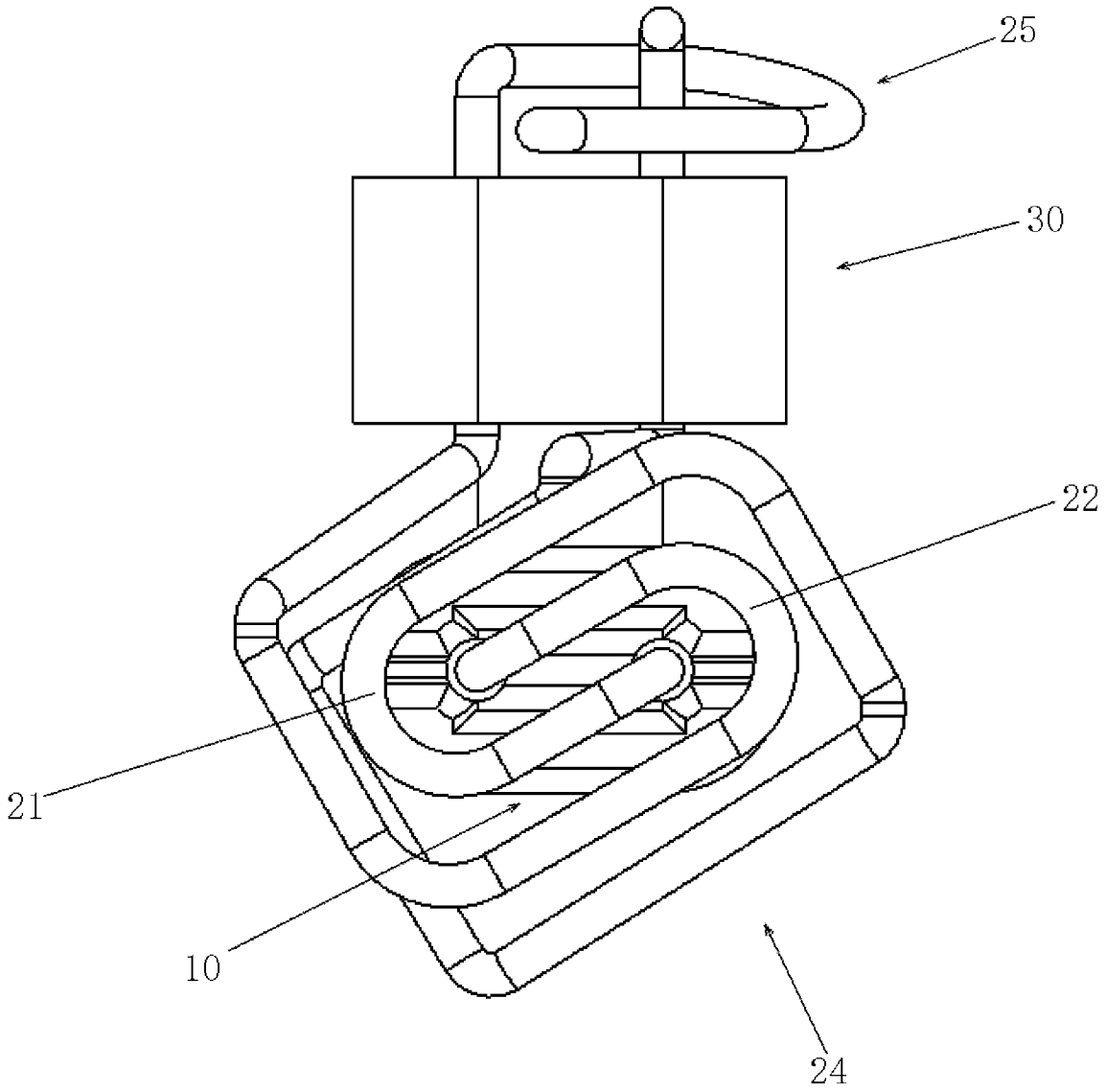
FIG. 13 is a schematic top view of the quick string-tying device of the present application shown in FIG. 11.
Figure 14:
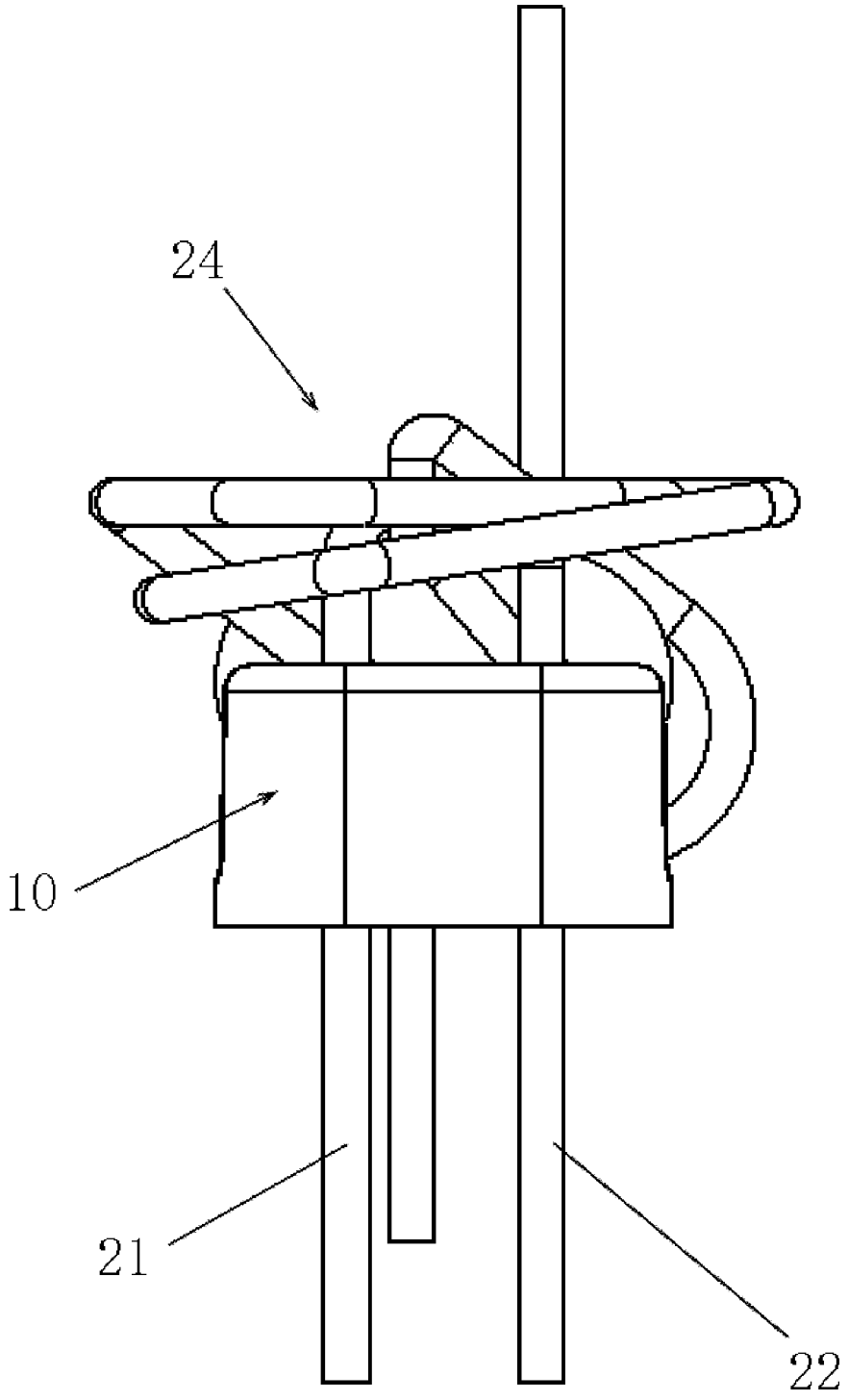
FIG. 14 is a schematic front view of the quick string-tying device of the present application shown in FIG. 11.
Figure 15:
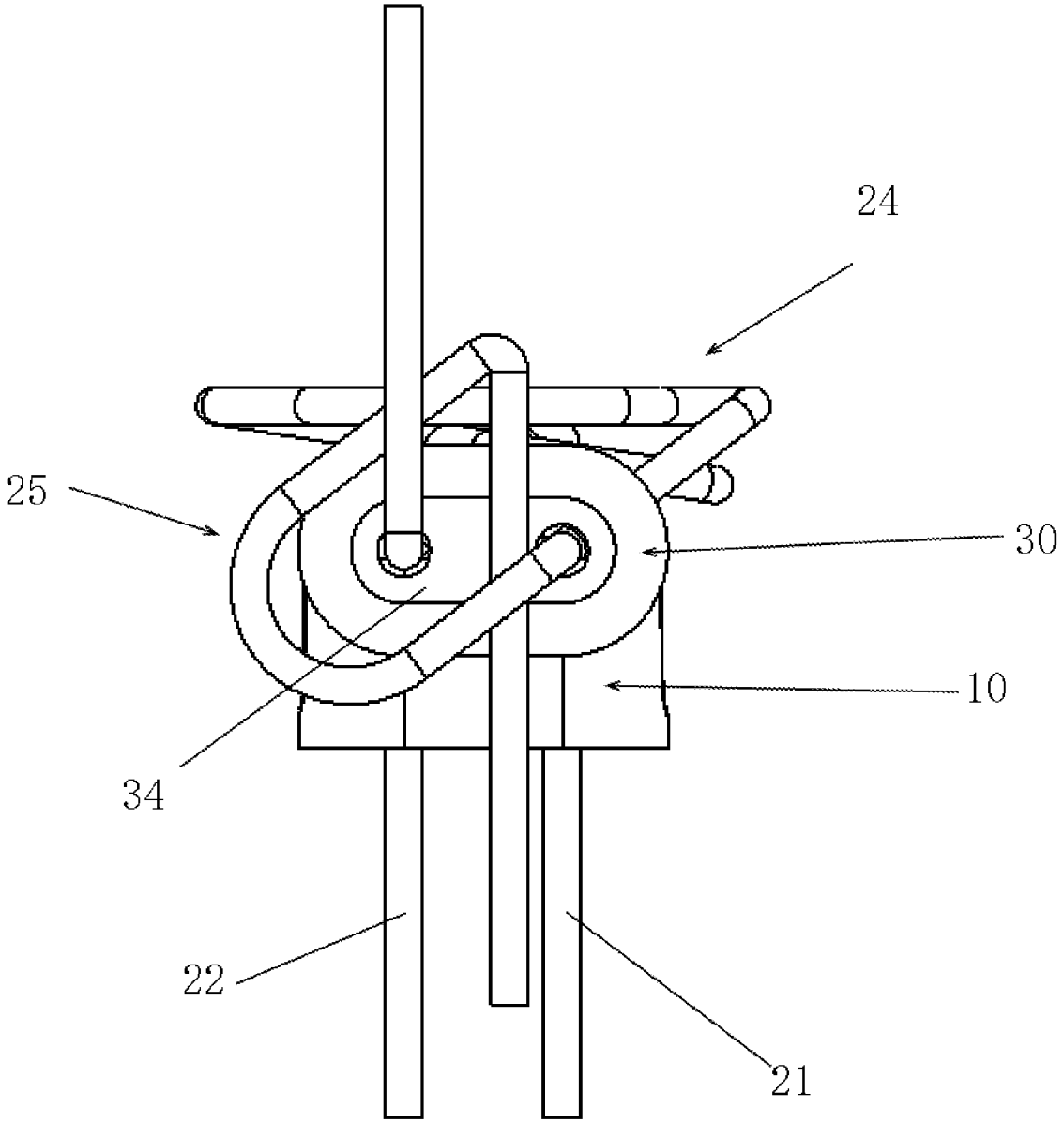
FIG. 15 is a schematic rear view of the quick string-tying device of the present application shown in FIG. 11.

FIG. 5 is a schematic view of another embodiment of the quick string-tying device of the present application, in this embodiment, the quick string-tying device includes a first case body 10 and a second case body 30, and a connecting portion 40 connecting the first case body 10 and the second case body 30, the first case body 10, second case body 30, and the connecting portion 40 may be integrally formed. The structure of the first case body 10 is basically the same as the structure of the first case body 10 of the first embodiment of the quick string-tying device of the present application, the device also includes a first bottom portion 11, a first open end 12, and a first sidewall 13 that is extending and formed from the first bottom portion 11 towards the first open end 12, the first bottom portion 11 is provided thereon with two first string-passing openings 111, two slit 131 are formed on the first sidewall 13, the first sidewall 13 and the first bottom portion 11 are surrounding to form a first accommodation space 14. The structure of the second case body 30 is basically the same as the structure of the first case body 10 of the first embodiment of the quick string-tying device of the present application, the second sidewall 33 of the second case body 30 does not have slits, the second case body 30 includes a second bottom portion 31, a second open end 32, and the second sidewall 33 that is extending and formed from the second bottom portion 31 towards the second open end 32, the second bottom portion 31 is provided with two second string-passing openings 311, the second bottom portion 31 and the second sidewall 33 form a second accommodation space 34 (see FIG. 10 and FIG. 15), it should be understood that the second string-passing openings 311 may also be provided on the second sidewall 33. When tying the two free ends 21, 22 of the string, the two free ends 21, 22 of the string are passed through the first string-passing openings 111 of the first case body 10, tied into a knot or twisted, and passed through the second string-passing openings 311 of the second case body 30, and then tied into a slipknot and clamped in the second accommodation space 34, this can achieve the object of the quick string-tying device. It should be understood that the first case body 10 and the second case body 30 may be integrally formed, and may also be two separate parts, the orientation and position of the first case body 10 and second case body 30 are not limited to the form shown in FIG. 5, they can be in any appropriate form. Due to the second case body 30, the tied slipknot or the twisted portion in the first case body 10 will not become loose. Since the slipknot or the twisted portion always exists, the string at the upper and lower of the slipknot or twisted portion can be pulled for tightening or loosening. The slipknot or the twisted portion needs not be entirely entered into the first accommodation space 14. The slits 131 may be formed and extending in a direction from the open end towards the bottom portion, however, the slits 131 may end at any designated position, the function of the slits 131 is to reduce the extent of relative movement of the first case body. For example, when the slits 131 extend to the bottom portion, the extent of the required relative movement of the first case body 10 is changed to zero.

FIG. 6 to FIG. 10 show schematic diagrams of a string-tying method for another embodiment of the quick string-tying device of the present application, two free ends 21, 22 of the string are passed through the first string-passing openings 111 of the first case body 10, tied into a slipknot 23, passed continuously through the second string-passing openings 311 of the second case body 30, and then tied into another slipknot 25, the slipknot 25 can be pulled into the second accommodation space 34 so as to hold the head portions of the two free ends 21, 22 of the string. The length of the two free ends 21, 22 of the string between the first case body 10 and the second case body 30 can be quickly adjusted, after the length of the two free ends 21, 22 of the string between the first case body 10 and the second case body 30 is adjusted, the slipknot 23 can be locked in the first accommodation space 14 of the first case body 10, the two free ends 21, 22 of the string are then locked, when loosening is required, the slipknot 23 is pulled out from the first accommodation space 14, the two free ends 21, 22 of the string can be loosened. The portion of the two free ends 21, 22 of the string between the first case body 10 and the second case body 30 may be pressed into the slits 131 to further lock the two free ends 21, 22 of the string. The portion of the two free ends 21, 22 of the string between the first case body 10 and the second case body 30 may be formed into the shape of a bowknot.

FIG. 11 to FIG. 15 show schematic diagrams of another string-tying method for another embodiment of the quick string-tying device of the present application, the two free ends 21, 22 of the string are passed through the first string-passing openings 111 of the first case body 10, twisted against each other to form a twisted portion 24, continuously passed through the second string-passing openings 311 of the second case body 30, and tied into a slipknot 25, the slipknot 25 can be pulled into the second accommodation space 34 so as to hold the end portions of the two free ends 21, 22 of the string. The length of the two free ends 21, 22 of the string between the first case body 10 and the second case body 30 can be quickly adjusted, after the length of the two free ends 21, 22 of the string between the first case body 10 and the second case body 30 are adjusted, the twisted portion 24 can be locked in the first accommodation space 14 of the first case body 10, the two free ends 21, 22 of the string are then locked, when loosening is required, the twisted portion 24 is pulled out from the first accommodation space 14, the two free ends 21, 22 of the string can be loosened. The portion of the two free ends 21, 22 of the string between the first case body 10 and the second case body 30 may be pressed into the slits 131 to further lock the two free ends 21, 22 of the string. The portion of the two free ends 21, 22 of the string between the first case body 10 and the second case body 30 may be formed into the shape of a bowknot.

Figure 16:
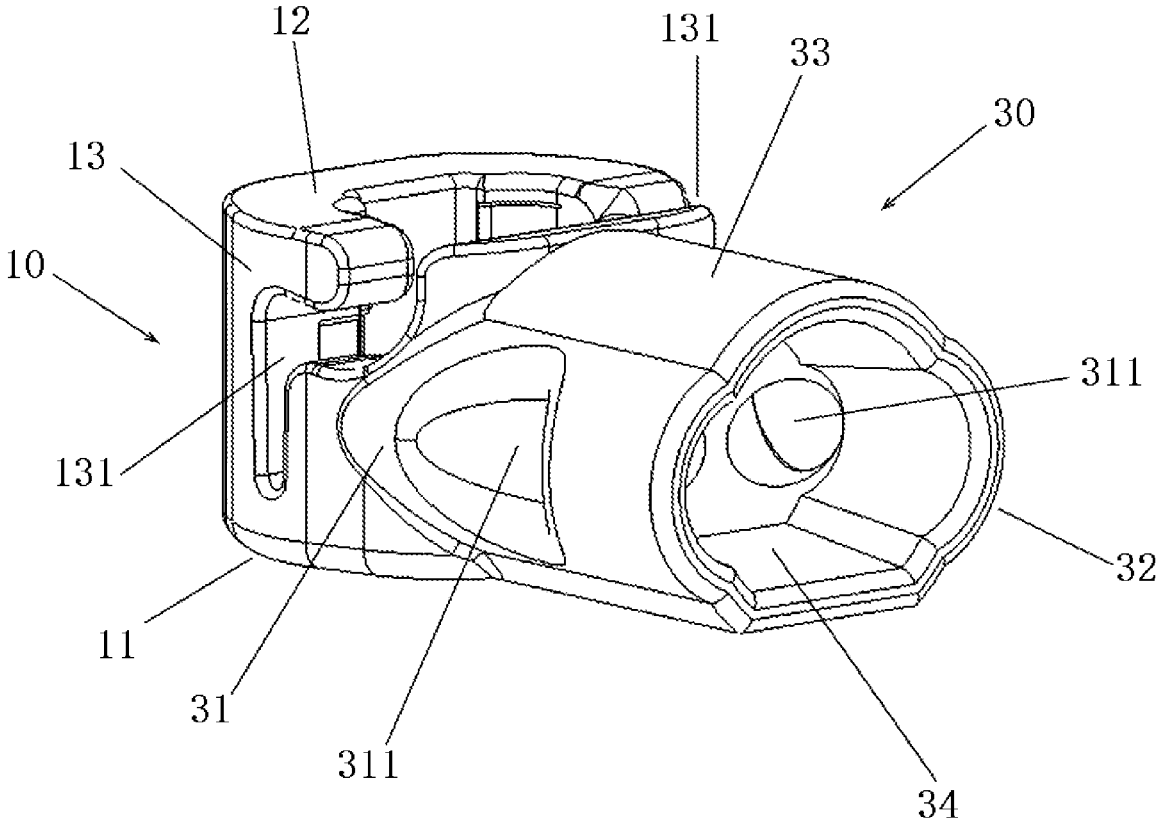
FIG. 16 is a perspective schematic view of yet another embodiment of the quick string-tying device of the present application.
Figure 17:
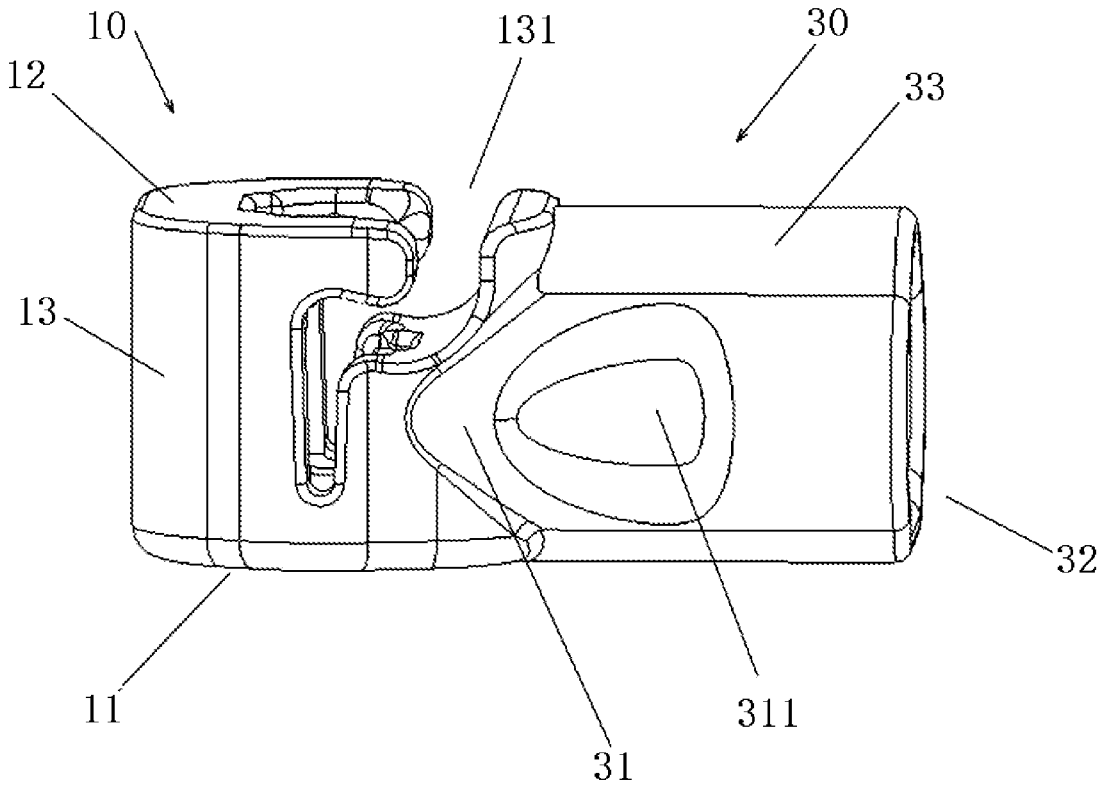
FIG. 17 is a schematic side view of the quick string-tying device of the present application shown in FIG. 16.

FIG. 16 and FIG. 17 are schematic views of another embodiment of the quick string-tying device of the present application, in this embodiment, the quick string-tying device includes a first case body 10 and a second case body 30, the first case body 10 is provided with a first bottom portion 11, a first open end 12, and a first sidewall 13 being formed and extending from the first bottom portion 11 towards the first open end 12, it is similar to the structure of the first case body 10 in the first embodiment, in this embodiment, the first bottom portion 11 and the first sidewall 13 of the first case body 10 form a first accommodation space 14, the first bottom portion 11 is provided with two first string-passing openings 111 for the two free ends 21, 22 of the string to pass therethrough respectively, the second case body 30 and the first case body 10 may be integrally formed, specifically, the second case body 30 is formed and extending from an outer side of the first sidewall 13 of the first case body 10 in a direction away from the first sidewall 13, the second case body 30 includes a second bottom portion 31 formed on the first sidewall 13, a second open end 32 formed away from the first sidewall 13, and a second sidewall 33 being formed and extending from the second bottom portion 31 towards the second open end 32, the second bottom portion 31 and the second sidewall 33 form a second accommodation space 34.

In this embodiment, two slits 131 are formed on the first sidewall 13 of the first case body 10 and are extending from the first open end 12 towards the first bottom portion 11, the slits 131 gradually taper along a direction from the first open end 12 towards the first bottom portion 11. Referring to FIG. 17, in this embodiment, the slits 131 are not always extending along one direction, the slits 131 first extend from the first open end 12 towards the first bottom portion 11, and then extend towards one side, and then extend in a direction towards the first bottom portion 11. Two sides of the second sidewall 33 near the second bottom portion 31 are respectfully provided with two second string-passing openings 311, the position of the two second string-passing openings 311 is close to the slits 131. Compared to the embodiment shown in FIG. 5, in this embodiment, the second case body 30 is formed directly on the first case body 10, there is no connecting portion between the two case bodies.

Figure 18:
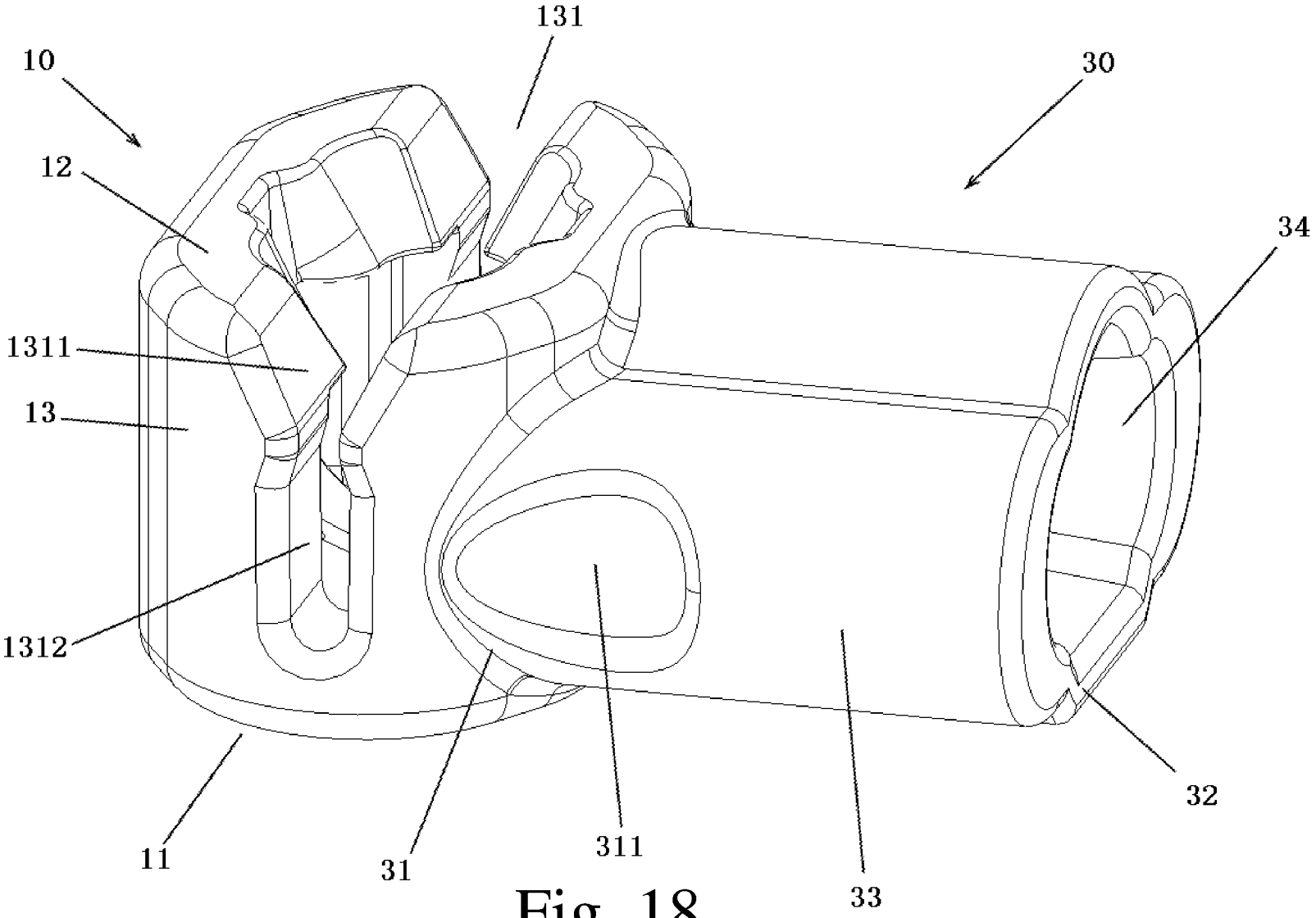
FIG. 18 is a perspective schematic view of a further embodiment of the quick string-tying device of the present application.

FIG. 18 is a schematic view of a further embodiment of the quick string-tying device of the present application, the basic structure of the quick string-tying device of this embodiment is the same as the basic structure of the quick string-tying device shown in FIG. 16 and FIG. 17, the device also includes integrally formed first case body 10 and second case body 30, the second case body 30 is formed on the sidewall of the first case body 10, the difference of these two embodiments is merely that the shape of the slits 131 is different, in this embodiment, each slit 131 includes a V-shaped opening section 1311 and an upright section 1312 connected to the V-shaped opening section, the V-shaped opening section can play the role of guiding the string into the upright section in order to facilitate tying of the string. The width of a narrowest gap of the V-shaped opening section which is joined to the upright section is smaller, preferably slightly smaller, than the width of the string, so that after a free end of the string is forced through the narrowest gap of the V-shaped opening section and into the upright section, the free end of the string cannot move out of the upright section by itself.

It should be understood that the first case body 10 and the second case body 30 of the quick string-tying device of the present application can be two independent parts, the two case bodies do not have connecting relationship, so long as the second case body can be fixed at a specific position, for example, the second case body can be fixed on items, such as shoes or clothes, etc. that use the quick string-tying device.

The quick string-tying device of the present application is suitable for various items that need to be tied by a string, such as shoes, clothes, bags, pouches, and other items with strings.

The embodiments of the present application have been described above in conjunction with the accompanying drawings. However, the present application is not limited to the specific embodiments described above, which are merely illustrative and not restrictive. Those of ordinary skill in the art, under the enlightenment of the present application, can make various forms, without departing from the purpose of the present application and the scope of protection of the claims, which are all within the protection of the present application.

What is claimed is:

1. A quick string-tying device, comprising a first case body, the first case body being provided with a first bottom portion, a first open end, and a first sidewall extending and formed from the first bottom portion towards the first open end, the first bottom portion and the first sidewall forming a first accommodation space, the first bottom portion being provided with a first string-passing opening for two free ends of a string to pass therethrough, a slit formed on the first sidewall and extending from the first open end towards the first bottom portion, the slit being used to clamp the two free ends of the string which enter into the slit;

wherein the slit comprises a V-shaped opening section and an upright section connected to the V-shaped opening section, and a width of a narrowest gap of the V-shaped opening section which is joined to the upright section is smaller than a width of the string.

2. The quick string-tying device according to claim 1, wherein the slit gradually tapers along a direction from the first open end towards the first bottom portion.

3. The quick string-tying device according to claim 1, wherein the first bottom portion is provided with two first string-passing openings for passing the two ends of the string therethrough respectively.

4. The quick string-tying device according to claim 1, wherein the first sidewall is formed with a second slit extending from the first open end towards the first bottom portion.

5. The quick string-tying device according to claim 1, further comprising a second case body, the second case body comprising a second bottom portion, a second open end, and a second sidewall extending and formed from the second bottom portion towards the second open end, the second bottom portion and the second sidewall forming a second accommodation space, the second case body being provided with a second string-passing opening for the two free ends of the string to pass therethrough.

6. The quick string-tying device according to claim 5, wherein the first case body and the second case body are connected by a connecting portion.

7. The quick string-tying device according to claim 6, wherein the second string-passing opening is provided on the second bottom portion of the second case body.

8. The quick string-tying device according to claim 5, wherein the second case body extends from an outer side of the first sidewall of the first case body in a direction away from the first sidewall, the second bottom portion being formed at the first sidewall.

9. The quick string-tying device according to claim 8, wherein the second string-passing opening is provided on the second sidewall or the second bottom portion.

10. A method for tying a string, comprising:

providing a quick string-tying device, the quick string-tying device comprising a first case body, the first case body being provided with a first bottom portion, a first open end, and a first sidewall extending and formed from the first bottom portion towards the first open end, the first bottom portion and the first sidewall forming a first accommodation space, the first bottom portion being provided with a first string-passing opening, a slit formed on the first sidewall and extending from the first open end towards the first bottom portion;

passing two free ends of a string through the first string-passing opening;

tying a slipknot with the two free ends or twisting the two free ends against each other to form a twisted portion; and moving the first case body upwards, or pulling the slipknot or the twisted portion downwards and into the first accommodation space, so that the slipknot or the twisted portion is clamped by the first accommodation space.

11. The method for tying a string according to claim 10, wherein the first bottom portion is provided with two first string-passing openings, and the passing step comprises passing the two free ends of the string through the two first string-passing openings respectively.

12. The method for tying a string according to claim 10, further comprising, after the slipknot or the twisted portion is clamped by the first accommodation space, forcing the two free ends of the string into the slit.

13. A method for tying a string, comprising:

providing a quick string-tying device, the quick string-tying device comprising a first case body, the first case body being provided with a first bottom portion, a first open end, and a first sidewall extending and formed from the first bottom portion towards the first open end, the first bottom portion and the first sidewall forming a first accommodation space, the first bottom portion being provided with a first string-passing opening, a slit formed on the first sidewall and extending from the first open end towards the first bottom portion, and a second case body, the second case body comprising a second bottom portion, a second open end, and a second sidewall extending and formed from the second bottom portion towards the second open end, the second bottom portion and the second sidewall forming a second accommodation space, the second case body being provided with a second string-passing opening;

passing two free ends of a string through the first string-passing opening;

tying a first slipknot with the two free ends or twisting the two free ends against each other to form a twisted portion;

continuously passing the two free ends through the second string-passing opening;

tying a second slipknot with the two free ends;

pulling the second slipknot into the second accommodation space so that the two free ends are secured in the second accommodation space; and adjusting a length of the two free ends between the first and second case bodies so that the first slipknot or the twisted portion is locked in the first accommodation space.

14. The method for tying a string according to claim 13, wherein the first bottom portion is provided with two first string-passing openings, and the passing step comprises passing the two free ends of the string through the two first string-passing openings respectively.

15. The method for tying a string according to claim 13, further comprising:

pressing a portion of the two free ends between the first and second case bodies into the slit.

* * * * *